US006132282A

United States Patent [19]

Camp

[11] Patent Number: 6,132,282

[45] **Date of Patent: *Oct. 17, 2000**

[54] MULTI-CONFIGURATION BALL

[76] Inventor: Richard S. Camp, P.O. Box 413, Corte Madera, Calif. 94925

[ * ] Notice: This patent issued on a continued prosecution application filed under 37 CFR 1.53(d), and is subject to the twenty year patent term provisions of 35 U.S.C. 154(a)(2).

[21] Appl. No.: 09/121,225

[22] Filed: Jul. 22, 1998

Related U.S. Application Data

[63] Continuation of application No. 08/710,313, Sep. 16, 1996, Pat. No. 5,785,571.

[51] Int. Cl.[7] ..... A63H 33/04; A63B 43/00

[52] U.S. Cl. ..... 446/124; 446/85; 446/569

[58] Field of Search ..... 446/85, 120, 124; 473/569, 594

[56] References Cited

U.S. PATENT DOCUMENTS

| | | | |
|---|---|---|---|
| 104,884 | 6/1870 | Reinshagen . | |
| 1,997,958 | 6/1935 | Wingard | 473/569 |
| 2,383,441 | 8/1945 | Beile | 46/223 |
| 2,540,369 | 2/1951 | Hume | 446/124 |
| 2,712,447 | 7/1955 | Steinhardt | 446/124 |
| 3,604,130 | 9/1971 | Forsstrom | 446/124 |
| 3,805,444 | 4/1974 | Adickes . | |
| 3,884,466 | 5/1975 | MacDonald et al. | 273/65 EC |
| 4,040,630 | 8/1977 | Brattain | 273/157 R |
| 4,129,963 | 12/1978 | Perry, Jr. et al. . | |
| 4,213,266 | 7/1980 | Hyland et al. | 473/594 |
| 4,217,724 | 8/1980 | Schoenfield et al. | 446/124 |
| 4,392,279 | 7/1983 | Schwager | 24/221 R |
| 4,429,938 | 2/1984 | Flor | 339/90 R |
| 4,599,077 | 7/1986 | Vuillard | 446/85 |
| 4,690,656 | 9/1987 | Friedman et al. | 446/95 |
| 4,830,364 | 5/1989 | Wexler | 473/569 |
| 4,930,645 | 6/1990 | Warehime | 215/11.1 |
| 4,932,672 | 6/1990 | Tippmann | 273/428 |
| 4,991,847 | 2/1991 | Rudell et al. | 473/594 |
| 5,260,512 | 11/1993 | Chomette et al. | 84/644 |
| 5,284,341 | 2/1994 | Routzong et al. | 273/65 EF |
| 5,513,622 | 5/1996 | Musacchia, Sr. | 124/89 |

FOREIGN PATENT DOCUMENTS

| | | | |
|---|---|---|---|
| 2731740 | 1/1979 | Germany | 446/124 |

OTHER PUBLICATIONS

Photo of *Nerf Turbo Torch Football*, Kenner Corp. 1992, a division of Tonka Corp., Cincinnati, OH 45202.

Photo of *Nick & Nerf Brainball*, Kenner Corp, 1995, a division of Tonka Corp., a subsidiary of Hasbro, Inc., Pawtucket, R.I. 02862.

Photo of *Nerf Turbo Liquidator*, Kenner Corp., (year of production not provided).

*Primary Examiner*—Robert A. Hafer
*Assistant Examiner*—Laura Fossum
*Attorney, Agent, or Firm*—Fenwick & West LLP

[57] ABSTRACT

A multi-configuration amusement device in the shape of a ball includes a variety of mass components with axially-extending cylindrical bores, a lock fastener unit having a hollow cylindrical shaft, and an hollow cylindrical extension tube, with the lock fastener unit and the extension tube operably insertable into the cylindrical bores of the mass components, for locking the mass components together in a unitary configuration.

9 Claims, 14 Drawing Sheets

MULTI-CONFIGURATION BALL

RELATED APPLICATIONS

This application is a continuation of U.S. patent Ser. No. 08/710,313, filed on Sep. 16, 1996, issued as U.S. Pat. No. 5,785,571, and which is hereby incorporated by reference.

BACKGROUND

1. Field of the Invention

The present invention relates generally to amusement devices, and specifically to a multi-configuration ball comprising interchangeable components.

2. Description of the Related Art

Sales of toys and other amusement devices form a large part of the economy. Amusement devices are available in a vast array of sizes, shapes, colors, and forms. Among the most popular toys are various types of balls, including basketballs, footballs, baseballs, soccer balls, and the like. Balls enjoy great popularity, especially among younger people, because they are associated with numerous indoor and outdoor recreational activities. Over the years, balls and related toys have proven to be successful and entertaining staples of the toy industry.

Conventional balls, however, have drawbacks such as having only one possible configuration. For example, a regulation football cannot be changed into a smaller football when its owner's needs change. Thus, a non-configurable toy like a football may become obsolete before the end of its useful life.

In addition, the lack of configurability with conventional balls does not permit the owner to use imagination and creativity in fashioning new types of toys. Multi-configuration toys such as "erector sets" and Legos (TM) enhance creativity while generally retaining a longer useful life because of the greater number of possible configurations. These creativity-enhancing toys have met with considerable success in the marketplace.

Conventional multi-configuration toys, however, have drawbacks. For example, toys created from interchangeable components are often flimsy and have difficulty retaining their unitary shapes. A toy made out of Legos (TM) generally breaks when dropped or otherwise subjected to stress or shock. Thus, many multi-configuration toys are not well adapted to being used in vigorous recreational activities.

Therefore, there remains a need for an amusement device that combines the popularity and durability of conventional balls with the creativity-enhancing aspects of multi-configuration toys. In addition, there remains a need for a ball that does not become obsolete because it is limited to a single configuration. Moreover, there remains a need for a ball that inspires creativity and imagination by providing interchangeable components, whereby the owner can change the ball's size, form, color and other characteristics. Additionally, there remains a need for a multi-configuration ball that retains its unitary shape during vigorous recreational activities.

SUMMARY OF THE INVENTION

The present invention provides a novel multi-configuration amusement device. Composed of interchangeable parts, the present invention can be reconfigured in several respects, including size, form, and color, allowing the owner to use creativity and imagination in creating new configurations of the present invention. Thus, a multiconfiguration ball in accordance with the present invention is actually multiple balls in one.

In one aspect of the invention, a multi-configuration amusement device includes a first mass component having one or more projecting members, a second mass component having one or more receptacles for receiving the one or more projecting members of the first mass component, and a lock fastener for joining the first and second mass components. In another aspect of the invention, the projecting member has a T-shaped profile, and the receptacle has a first width at a first portion and a second width at a second portion, the first width being greater than the second width. This facilitates locking whereby the first and second mass components may be locked together by inserting the projecting member into the first portion of the receiving and applying oppositely directed rotational motion on the mass components to move the projecting member towards the second portion.

In still another aspect of the invention, first and second mass components are provided having first and second cylindrical bores. In accordance with the invention, a first lock fastener is provided, which includes an end portion coupled to an end of a hollow cylindrical sleeve having a greater length and a smaller diameter than the first cylindrical bore. The hollow cylindrical sleeve is inserted into a first side of the first mass component to pass through the first cylindrical bore. Also in accordance with the invention, a second lock fastener is provided, which includes an end portion coupled to an end of a cylindrical shaft having a diameter smaller than the hollow cylindrical sleeve and a length greater than the second cylindrical bore. The cylindrical shaft is inserted into a first side of the second mass component to pass through the second cylindrical bore and extend into the hollow cylindrical sleeve of the first lock fastener. In yet another aspect of the invention, the cylindrical shaft has at least one radial cylindrical projection, and the hollow cylindrical sleeve has at least one L-shaped notch for receiving the radial cylindrical projection, whereby the sleeve and the shaft may be locked together by inserting the radial cylindrical projection into the L-shaped notch and applying oppositely directed rotational motion to the end portions of the lock fasteners.

In yet another aspect of the invention, a third mass component is provided, which may be inserted between the first and second mass components to form a part of the amusement device.

DETAILED DESCRIPTION OF THE PREFERRED EMBODIMENT

The figures depict a preferred embodiment of the present invention for purposes of illustration only. One skilled in the art will readily recognize from the following discussion that alternative embodiments of the structures and methods illustrated herein may be employed without departing from the principles of the claimed invention.

Figure 1:
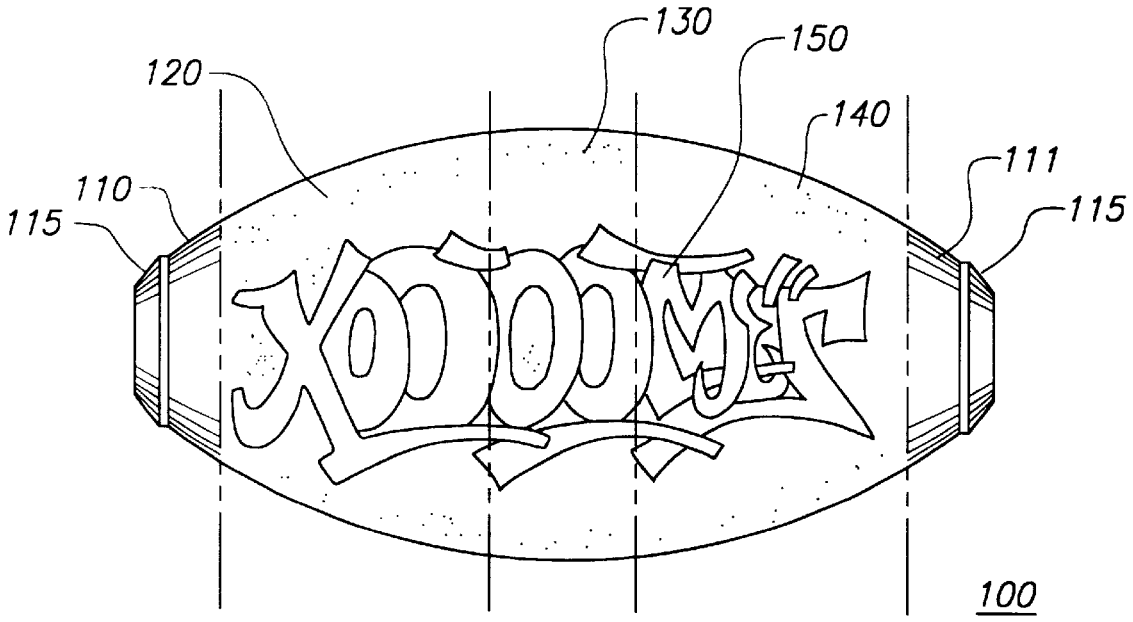
FIG. 1 is a side view of a multi-configuration ball in accordance with the present invention having three mass components.

Referring now to FIG. 1, there is shown a side view of a multi-configuration ball 100 in accordance with the present invention. Ball 100 includes a single lock fastening unit comprised of two portions—first and second lock fasteners 110 and 111, safety stoppers 115, three mass components—a first mass component 120, a center mass component 130 and a second mass component 140, and raised protrusions 150. FIG. 1 illustrates only the end portions of first and second lock fasteners 110 and 111, which are generally conical in shape, the top portion of the cone being removed. One skilled in the art will recognize, however, that the end portions of first and second lock fasteners 110 and 111 could comprise a variety of shapes. Preferably, first and second lock fasteners 110 and 111 comprise a two-part commercial epoxy resin and hardener, both of which are commercially available from Douglass and Sturgess, Inc. of San Fransisco, Calif. (e.g., epoxy resin type 7132 and hardner type 2001). The additional structures of first and second lock fasteners 110 and 111 are described in greater detail with reference to FIG. 5.

Disposed on the smaller ends of lock fasteners 110 and 111 are safety stoppers 115, which preferably comprise a soft, flexible material capable of absorbing shock. For example, safety stoppers 115 may comprise a two-part flexible commercial polyurethane foam. When ball 100 is thrown, safety stoppers 115 act as flexible buffers to prevent personal injury or property damage.

In accordance with the present invention, first, center and second mass components 120, 130, and 140 are provided. In a preferred embodiment, first, center and second mass components 120, 130, and 140 are shaped as right truncations of a sphere or ellipsoid, although other solid forms may be used such as a conical shape. Preferably, first, center and second mass components 120,130, and 140 include flexible commercial polyurethane foam, which is readily available in the art.

Raised protrusions 150 disposed on the surface of first, center and second mass components 120, 130, and 140. Such raised protrusions 150 may be formed of polyurethane foam and may be configured with lettering across the face of ball 100. For example, raised protrusions 150 may spell the word "Xoooomer," or any other desired word or phrase. The raised protrusions also help the player to more easily grip the surface of the mass components when catching, throwing, or carrying ball 100.

A multi-configuration ball 100 in accordance with the present invention offers significant advantages over conventional balls. For example, because of the modular design of ball 100, a player can add or delete components as his or her particular needs dictate. As detailed in the following discussion, a variety of interchangeable components are available, allowing a player to use creativity and imagination in creating new types of balls. Thus, a ball in accordance with the present invention is not limited to a single configuration as conventional balls are, and will not as readily become obsolete when a player's needs change.

Figure 2:
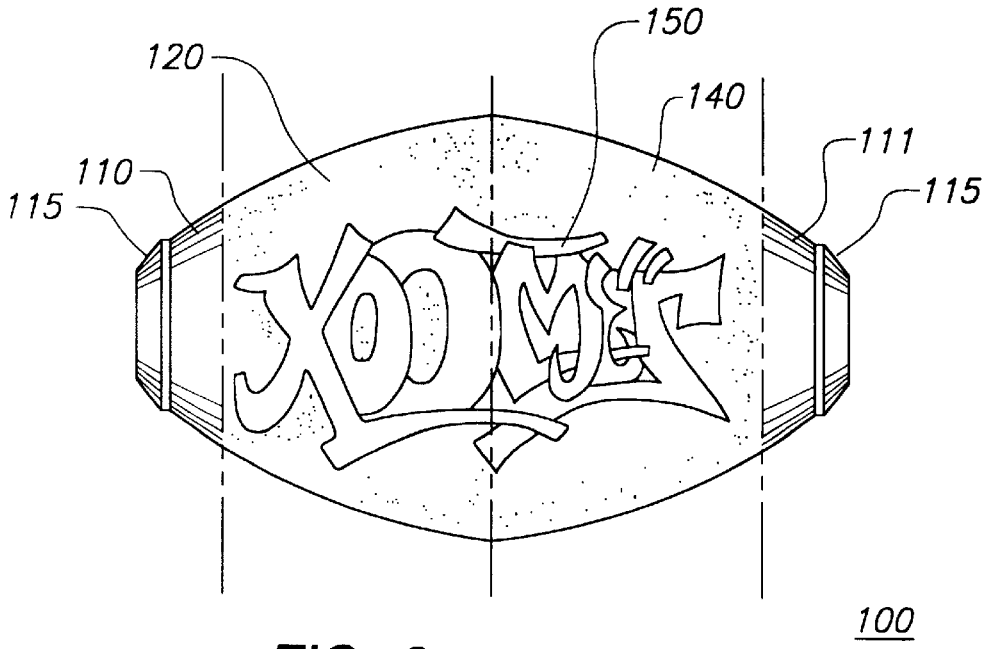
FIG. 2 is a side view of a multi-configuration ball in accordance with the present invention with the center mass component removed.

Referring now to FIG. 2, there is shown a side view of another embodiment of a multi-configuration ball 100 in accordance with the present invention. In this illustration, the center mass component 130 of ball 100 has been removed and the first mass component 120 is coupled to the second mass component 140. By eliminating center mass component 130, the player can create a ball having smaller dimensions, which may be appropriate for younger players or for applications where a smaller size is required. Additionally, raised protrusions 150 can be configured in such a way that removal of center mass component 130 will seamlessly alter the lettering of a message on the face of ball 100. For example, the lettering may be configured so that the removal of mass component 130 may only change the message of raised protrusions 150 from "Xoooomer" to "Xoomer."

Figure 3:
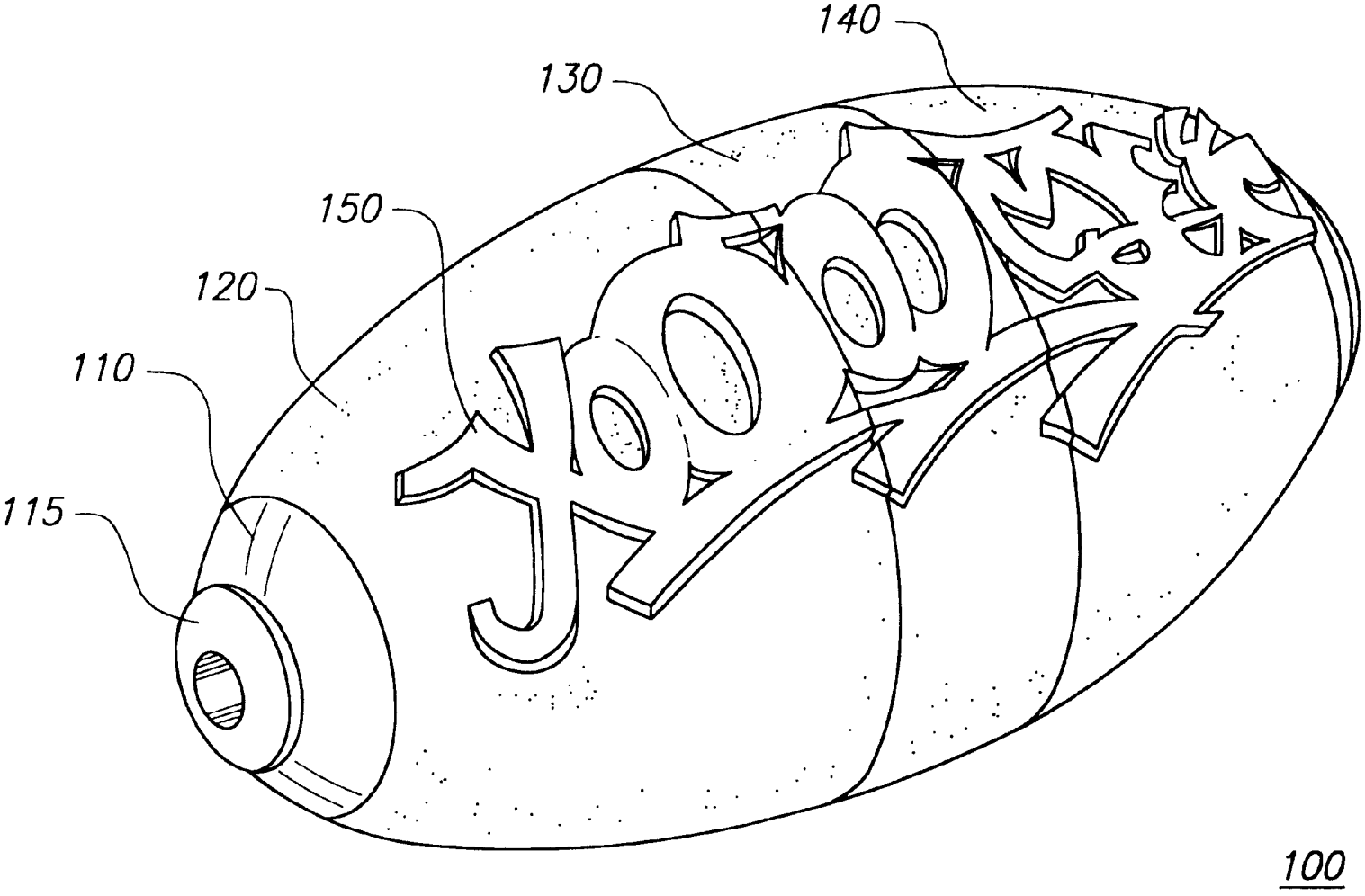
FIG. 3 is an oblique view of a multi-configuration ball in accordance with the present invention showing raised lettering.
Figure 4:
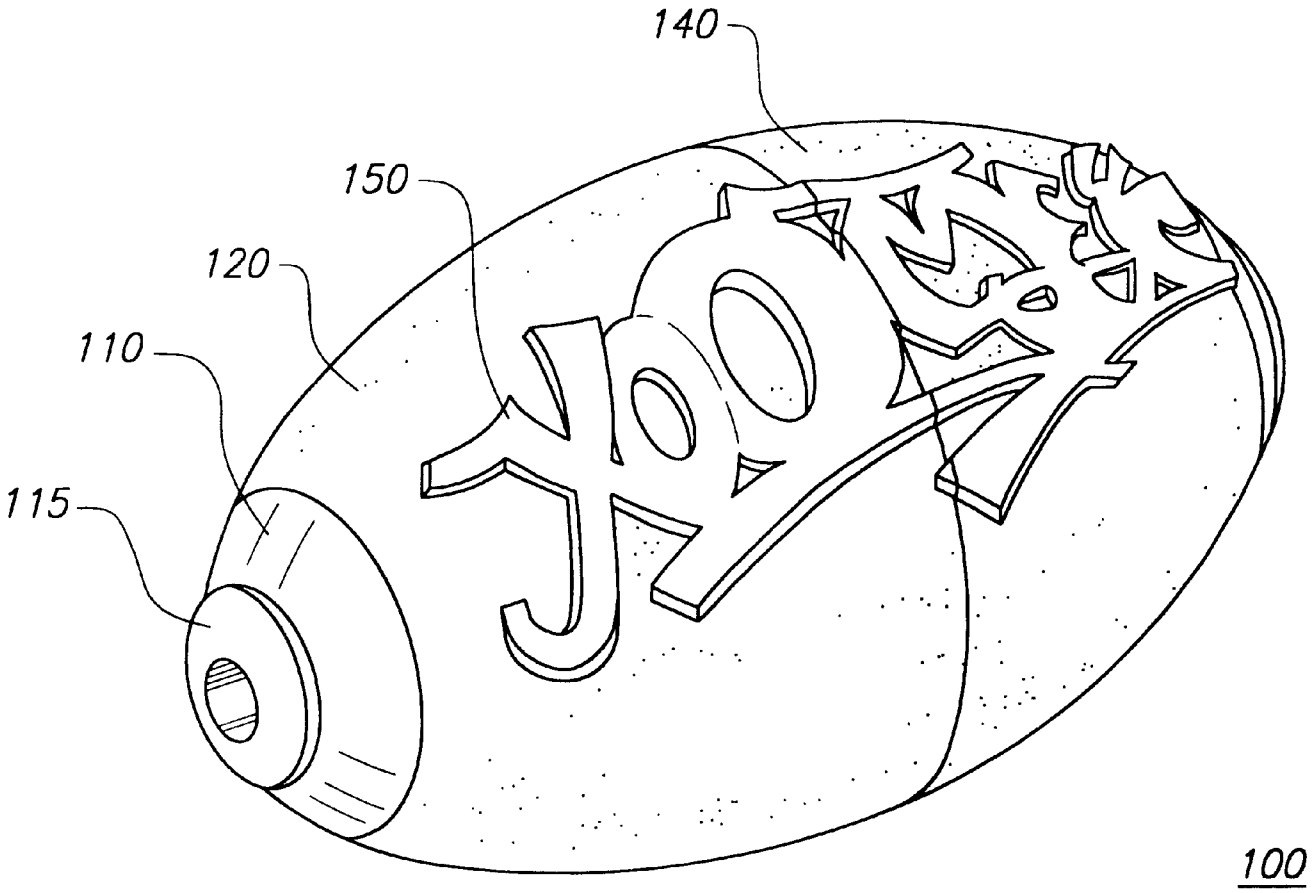
FIG. 4 is an oblique view of a multi-configuration ball in accordance with the present invention showing raised lettering and having the center mass component removed.

Referring now to FIG. 3, there is shown an oblique view of a ball 100 in accordance with the present invention, emphasizing the raised protrusions 150. As described earlier, such protrusions may not only suffice as lettering but may also assist the player in gripping ball 100. As further illustrated in FIG. 4, the removal of center mass component 130 seamlessly changes the message displayed by raised protrusions 150. In an alternative embodiment, the message or symbols may be recessed into mass components 120, 130, 140 rather than being raised protrusions.

Figure 5A:
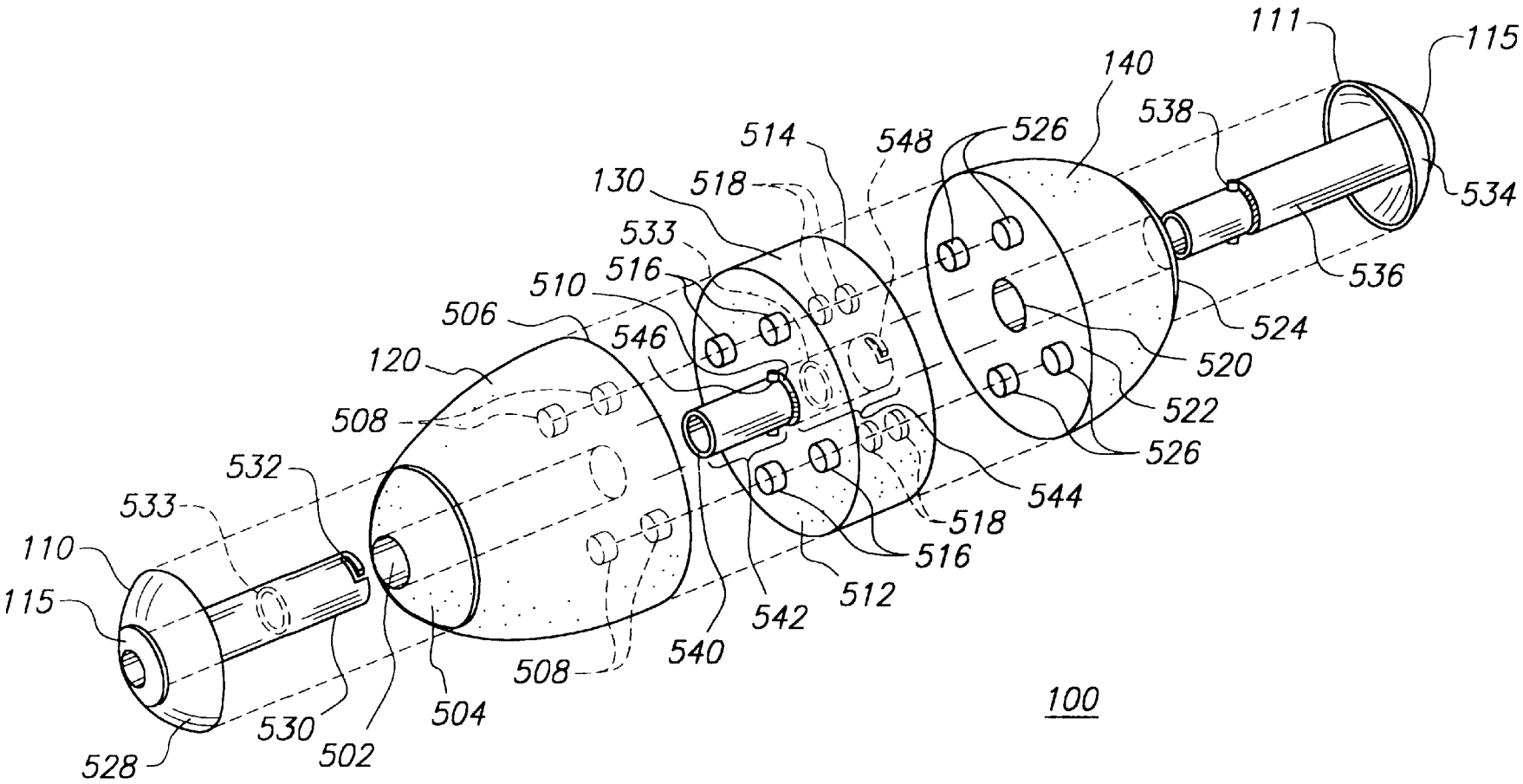
FIG. 5A is an exploded view of a multi-configuration ball in accordance with the present invention having three mass components.

FIG. 5A illustrates an exploded view of a multi-configuration ball 100. In accordance with the present invention, first mass component 120 comprises a cylindrical bore 502 extending axially between a first side 504 and a second side 506. First side 504 is recessed for receiving the end portion of first lock fastener 110 in order to create an even surface on the outer plane of ball 100. In a preferred embodiment, second side 506 comprises four cylindrical receptacles 508 spaced equidistantly from one another and from cylindrical bore 502.

Also in accordance with the present invention, center mass component 130 comprises a cylindrical bore 510 extending axially between first side 512 and second side 514. In a preferred embodiment, first side 512 of center mass component 130 comprises four cylindrical projections 516, having a smaller diameter than receptacles 508, and spaced equidistantly from one another and from cylindrical bore 510 such that cylindrical projections 516 may be operably inserted into receptacles 508. Additionally, second side 514 comprises four cylindrical receptacles 518 spaced equidistantly from one another and from cylindrical bore 510.

Further, second mass component 140 comprises a cylindrical bore 520 extending axially between first side 522 and second side 524. Second side 524 is recessed for receiving the end portion of lock fastener 111 in order to create an even surface on the outer plane of ball 100. In a preferred embodiment, first side 522 comprises four cylindrical projections 526 spaced equidistantly from one another and from cylindrical bore 520, having a smaller diameter than receptacles 518 of the center mass component 130, and spaced equidistantly from one another and from cylindrical bore 520 such that cylindrical projections 526 may be operably inserted into receptacles 518.

Figure 7A:
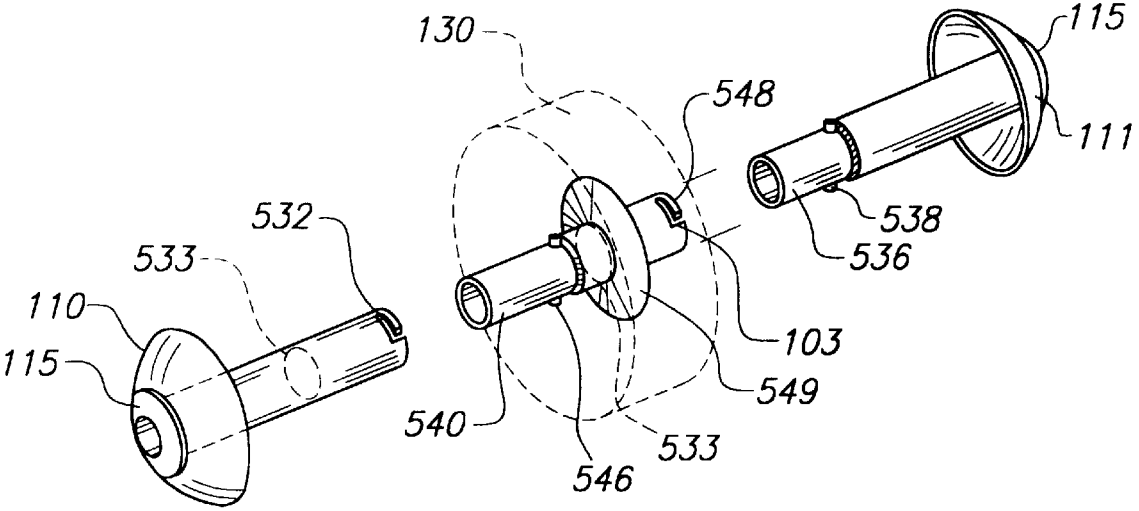
FIG. 7A is a diagram illustrating a three-part lock fastener unit in accordance with the present invention.

FIGS. 5A and 7A also illustrates components of the lock fastening unit, specifically first and second lock fasteners 110 and 111. In accordance with the present invention, first lock fastener 110 comprises an end portion 528 coupled to the end of a hollow cylindrical sleeve 530 having a greater length and a smaller diameter than cylindrical bore 502. Preferably, hollow cylindrical sleeve 530 comprises an L-shaped notch 532 at the distal end of sleeve 530. Hollow cylindrical sleeve 530 also comprises a washer 533 inserted midway into sleeve 530 and having substantially the same diameter as the inner diameter of sleeve 530.

Also, second lock fastener 111 comprises an end portion 534 coupled to the end of cylindrical shaft 536 having a diameter smaller than hollow cylindrical sleeve 530 and a length greater than cylindrical bore 520. Preferably, cylindrical shaft 536 comprises a radial cylindrical projection 538 at the distal end of shaft 536 for insertion into L-shaped notch 532.

Further, extension tube 540 comprises a first section 542 and a second section 544, each having different diameters. First section 542 has a diameter smaller than cylindrical sleeve 530 and comprises a radial cylindrical projection 546 for insertion into L-shaped notch 532. Second section 544 has a diameter greater than shaft 536 and comprises an L-shaped notch 548 for receiving radial cylindrical projection 538. Second section 544 also comprises a washer 533 inserted midway into second section 544 and having substantially the same diameter as the inner diameter of second section 544.

In accordance with the present invention, a user inserts hollow cylindrical sleeve 530 of first lock fastener 110 into cylindrical bore 502 on side 504 of first mass component 120. When fully inserted, end portion 528 is flush with recessed side 504, and hollow cylindrical sleeve 530 extends through bore 502 to project out of side 506. Similarly, a user inserts cylindrical shaft 536 of second lock fastener 111 into cylindrical bore 520 on side 524 of mass component 140. When fully inserted, end portion 534 is flush with recessed side 524, and cylindrical shaft 530 extends through bore 520 to project out of side 522. Finally, a user inserts extension tube 540 into cylindrical bore 510 of center mass component 130, such that section 542 projects out of side 512 of center mass component 130, and section 544 projects out of side 514.

Further in accordance with the present invention, a user combines first and center mass components 120, 130 in such a way that cylindrical projections 516 are inserted into receptacles 508, section 602 of extension tube 540 is inserted into hollow cylindrical sleeve 530, and radial cylindrical projection 546 is inserted into L-shaped notch 532. When fully inserted, section 542 seats up against washer 533 in hollow cylindrical sleeve 530. Similarly, a user combines center and second mass components 130, 140 in such a way that cylindrical projections 526 are inserted into receptacles 518, cylindrical shaft 536 is inserted into section 544 of extension tube 540, and radial cylindrical projection 538 is inserted into L-shaped notch 548. When fully inserted, cylindrical shaft 536 seats up against washer 533 in section 544 of extension tube 540.

Also in accordance with the present invention, the user applies oppositely directed rotational motion to each end portion 528, 534, such that radial cylindrical projection 546 enters the locked position of L-shaped notch 532, and radial cylindrical projection 538 enters the locked position of L-shaped notch 548. In a preferred embodiment, the user rotates each end portion 528, 534 in a clockwise direction when viewed from an anterior perspective from each end. Upon completion of the rotating step, first lock fastener 110 is joined to extension tube 540, extension tube 540 is joined to second lock fastener 111, and first, center, and second mass components 120, 130, 140 are held together in a unitary configuration. Thus, the present invention overcomes the deficiencies of the prior art by providing a multi-configuration toy that retains its unitary shape during vigorous recreational activities.

Figure 5B:
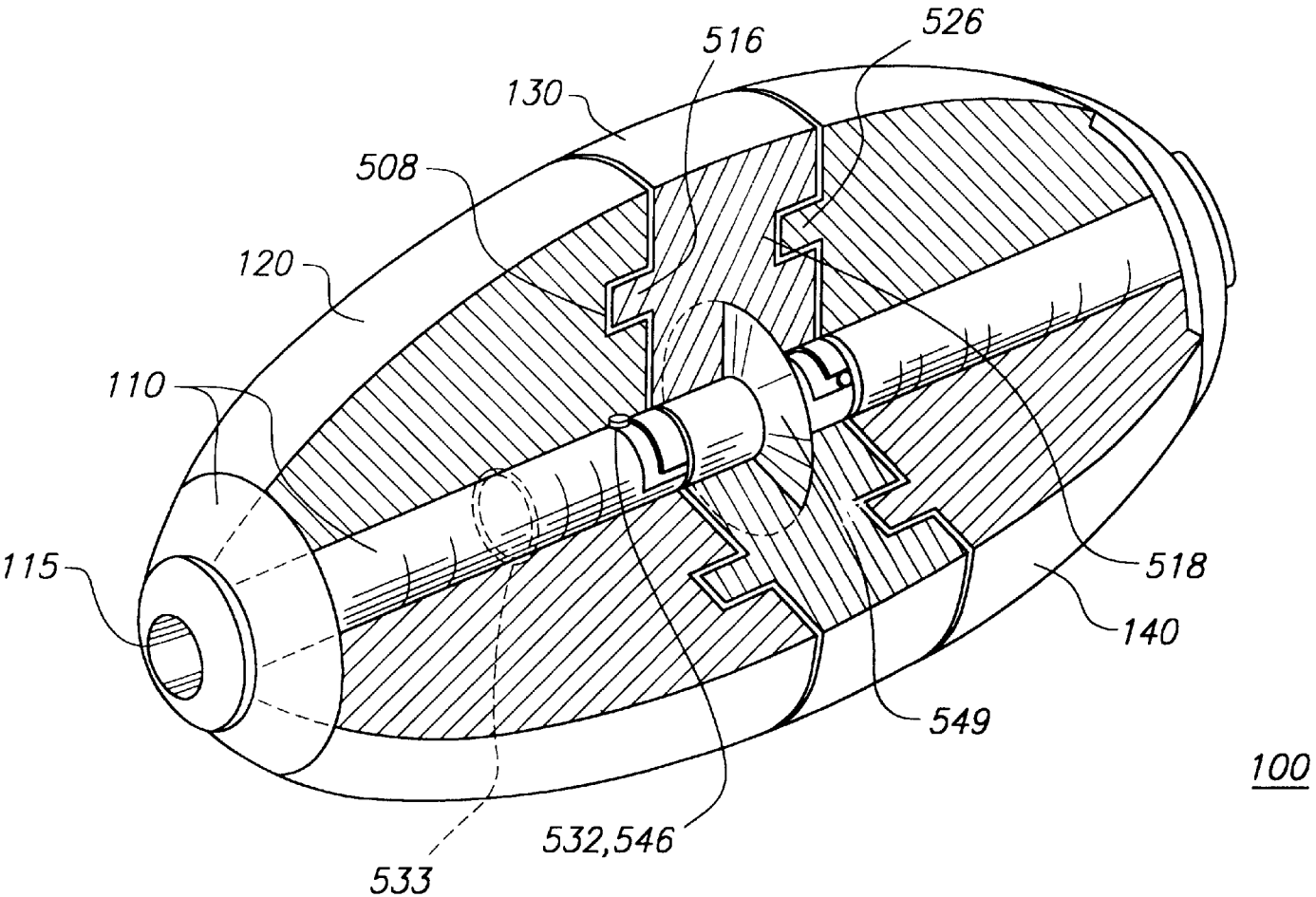
FIG. 5B is an oblique cross-sectional view of a multi-configuration ball illustrating a lock fastening unit coupling first, second, and center mass components in accordance with the present invention.

FIG. 5B illustrates an oblique cross-sectional view of a multi-configuration ball being fully assembled with the lock fastener unit in a locked position. As described above in FIG. 5A, first mass component 120 is coupled to center mass component 130 by fitting cylindrical projections 516 into receptacles 508 and inserting extension tube 540 into hollow cylindrical sleeve 530. Radial cylindrical projection 546 is fit into L-shaped notch 532 and rotated clockwise, for example, to lock first mass component 120 and center mass component 130 together. Similarly, second mass component 140 is coupled with center mass component 130 by inserting cylindrical projections 526 into receptacles 518 and cylindrical shaft 536 into extension tube 540. Radial cylindrical projection 538 is fit with L-shaped notch 548 and rotated clockwise, for example, to lock center mass component 130 and second mass component 140 together.

FIGS. 5B and 7A also illustrate a strengthening wheel 549 within center mass component 130. Strengthening wheel 549 provides functions such as strengthening the bond between the body mass and the core portion of center mass component 130. In a preferred embodiment, strengthening wheel 549 is incorporated into center mass component 130. In an alternative embodiment, strengthening wheel 549 is incorporated into the locking mechanism.

Figure 6A:
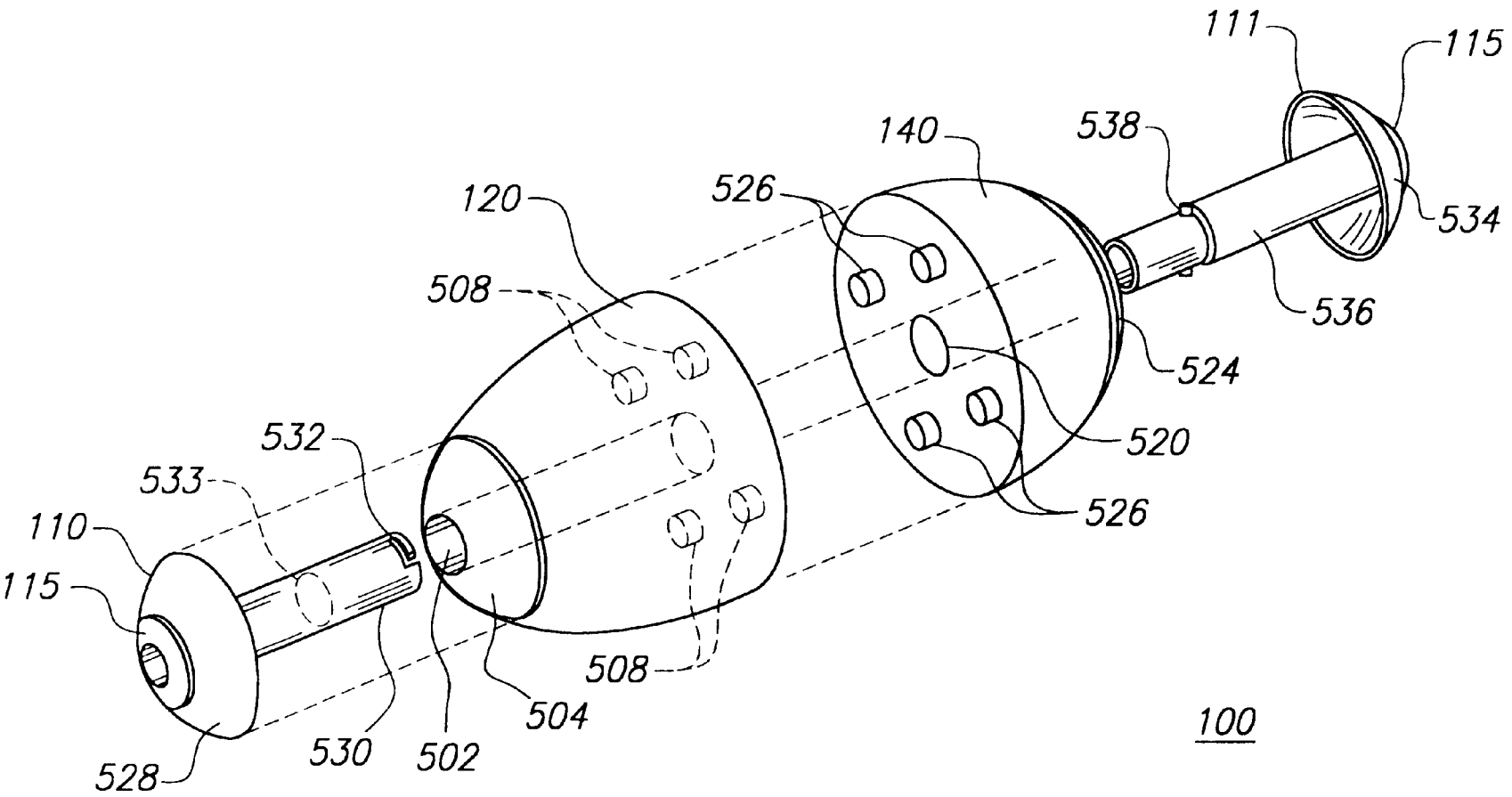
FIG. 6A is an exploded view of a multi-configuration ball in accordance with the present invention with the center mass component removed.
Figure 7B:
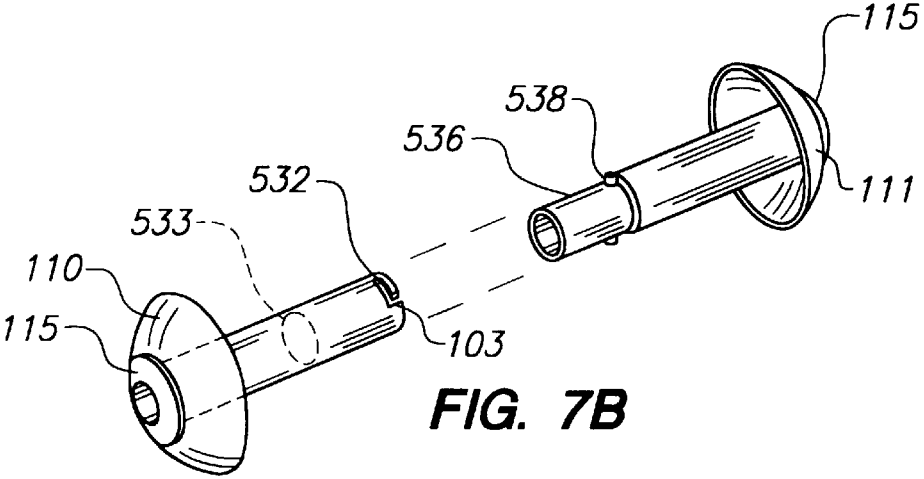
FIG. 7B is a diagram illustrating a two-part lock fastener unit in accordance with the present invention.

FIG. 6A illustrates an exploded view of an embodiment of multi-configuration ball 100 having center mass component 130 removed. The operation of ball 100 in this embodiment is substantially similar to that discussed with reference to FIGS. 5A and 5B. Referring to FIGS. 6A and 7B, a user inserts hollow cylindrical sleeve 530 of first lock fastener 110 into cylindrical bore 502 on side 504 of first mass component 120. When fully inserted, end portion 528 is flush with recessed side 504, and hollow cylindrical sleeve 530 extends through bore 502 to projects out of side 506. Similarly, a user inserts cylindrical shaft 536 of second lock fastener 111 into cylindrical bore 520 on side 524 of second mass component 140. When fully inserted, end portion 534 is flush with recessed side 524, and cylindrical shaft 530 extends through bore 520 to project out of side 522.

Further in accordance with the present invention, a user combines first and second mass components 120, 140 in such a way that cylindrical projections 526 are inserted into receptacles 508, cylindrical shaft 536 is inserted into hollow cylindrical sleeve 530, and radial cylindrical projection 538 is inserted into L-shaped notch 532. When fully inserted, cylindrical shaft 536 seats up against washer 533 in hollow cylindrical sleeve 530.

Also in accordance with the present invention, the user applies oppositely directed rotational motion to each end portion 528, 534 such that radial cylindrical projection 538 enters the locked position of L-shaped notch 532. In a preferred embodiment, the user rotates each end portion 528, 534 in a clockwise direction when viewed from an anterior perspective from each end. Upon completion of the rotating step, first lock fastener 110 is joined to second lock fastener 111, and first and second mass components 120, 140 are held together in a unitary configuration. Thus, the present invention provides a multi-configuration toy that retains its unitary shape even during vigorous recreational activities.

Figure 6B:
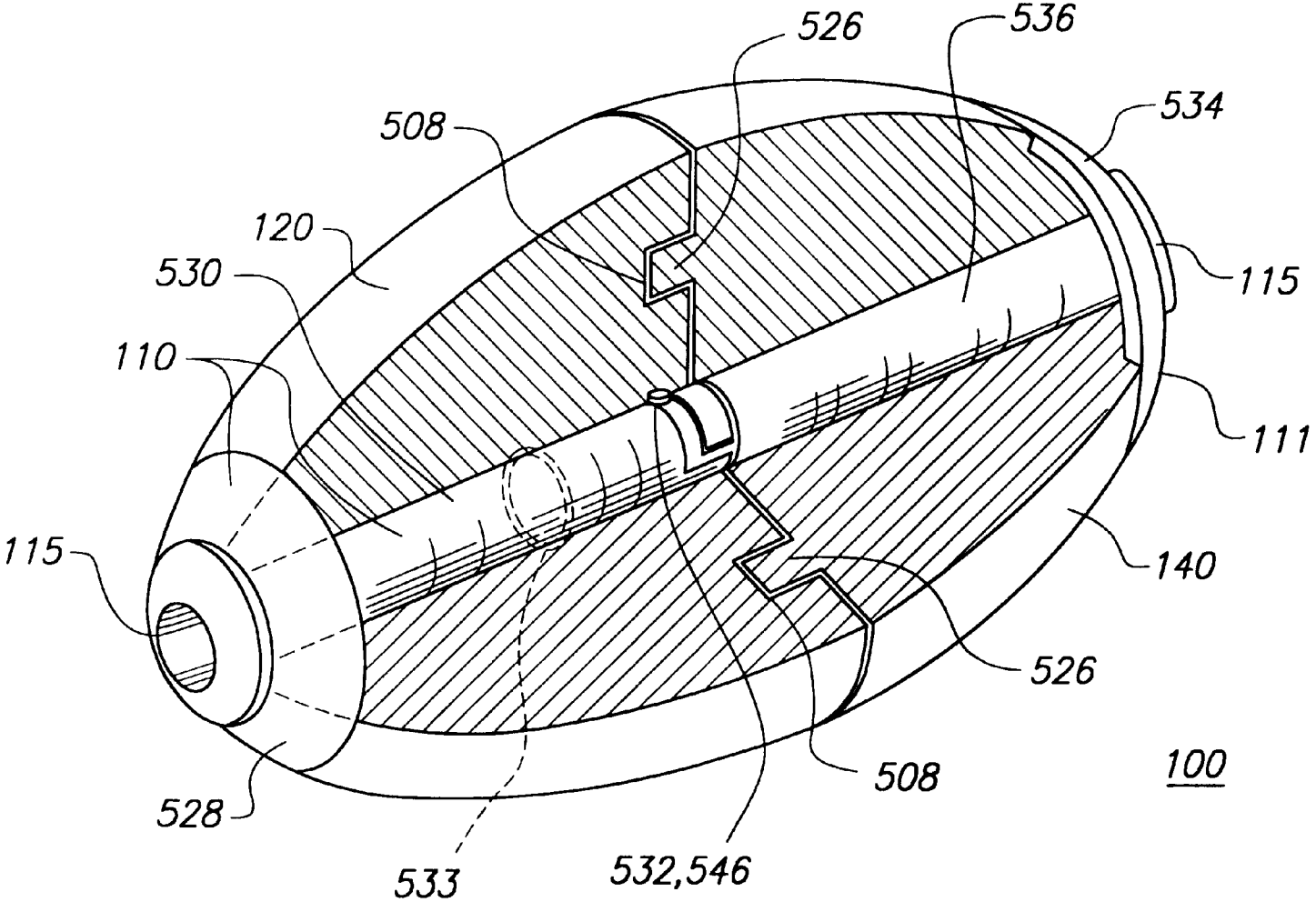
FIG. 6B is an oblique cross-sectional view of a multi-configuration ball illustrating a lock fastening unit coupling first and second mass components with the center mass component removed in accordance with the present invention.

FIG. 6B is an oblique cross-sectional view of a multi-configuration ball having center mass component 130 removed and coupling first mass component 120 with second mass component 140. As described above in FIG. 6A, cylindrical projections 526 are inserted into receptacles 508 and cylindrical shaft 536 is inserted into hollow cylindrical sleeve 530. Radial cylindrical projection is fit with L-shaped notch 532 and rotated clockwise, for example, to lock first mass component 120 and second mass component 140 together.

FIG. 7A is a diagram of a 3-part lock fastening unit in accordance with the present invention as described above in FIGS. 5A and 5B. FIG. 7B is a diagram of a 2-part lock fastening unit in accordance with the present invention as described above in FIGS. 6A and 6B.

Figure 7C:
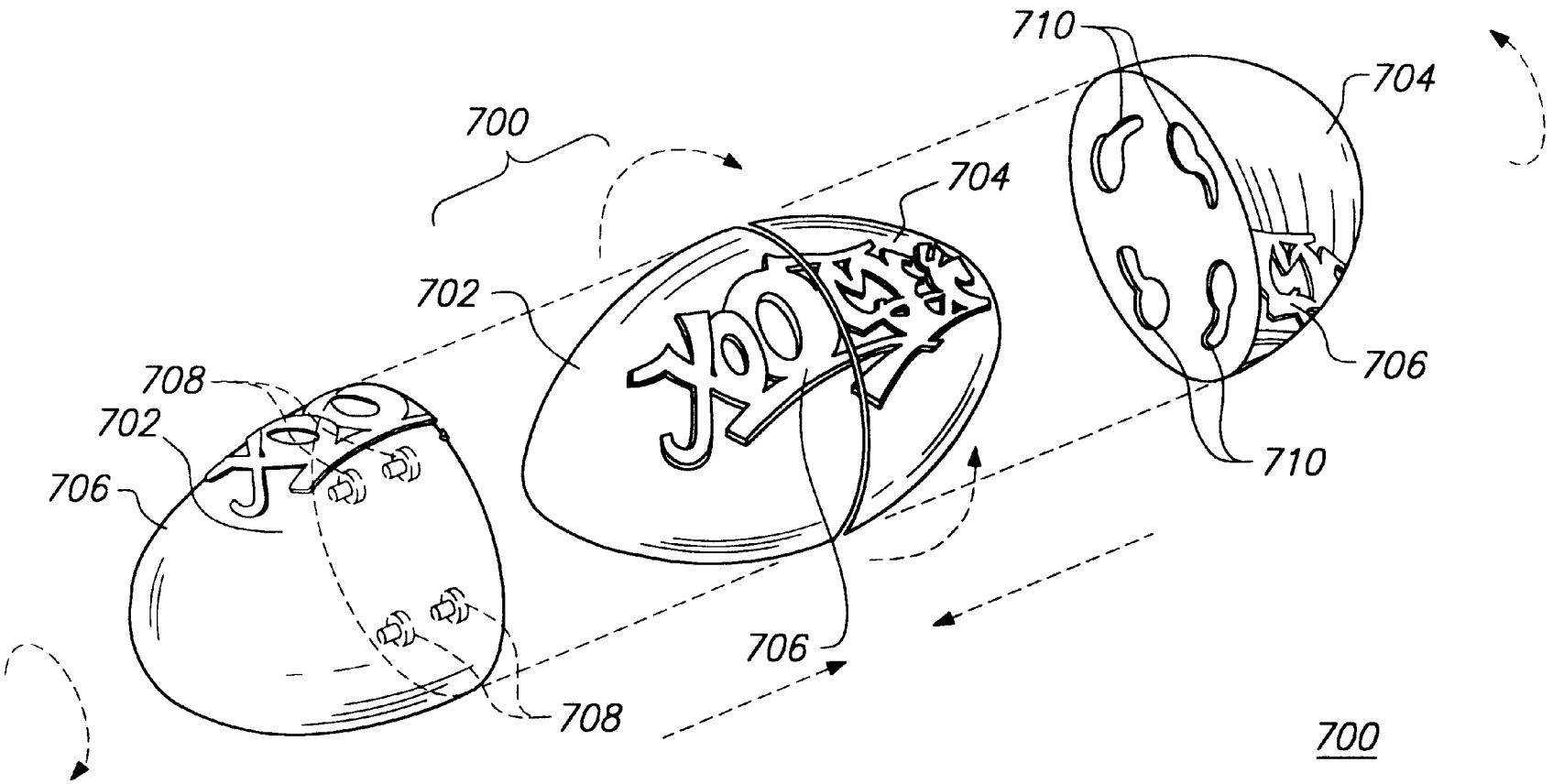
FIG. 7C is an exploded view of an embodiment of a multi-configuration ball in accordance with the present invention showing an alternative locking mechanism.

Referring now to FIG. 7C, there is shown an alternative embodiment of a multi-configuration ball locking mechanism. Ball 700 comprises a first mass component 702 and a second mass component 704. In a preferred embodiment, first and second mass components 702, 704 are shaped like right truncations of a sphere or ellipsoid. Preferably, first and second mass components 702, 704 include flexible commercial polyurethane foam.

Raised protrusions 706 are disposed on the surface of first and second mass components 702, 704. Such raised protrusions 706 are made of polyurethane foam and may be configured as lettering across the face of ball 700. The raised protrusions also help the player to more easily grip the surface of the mass components when catching, throwing, or carrying ball 700. In an alternative embodiment, the message or symbols may be recessed into first and second mass components 702, 704 rather than being raised protrusions.

In accordance with the present invention, the flat side of first mass component 702 preferably comprises four cylindrical projections 708 having a T-shaped profile and equidistantly spaced midway between the axial center and the edge of first mass component 702. Also in accordance with the present invention, second mass component 704 comprises four hole/slot receptacles 710, having a hole of sufficient diameter to receive T-shaped cylindrical projections 708 and a slot sufficiently narrow to engage the top portion of T-shaped projection 708 in a locked relationship.

In operation, the user combines first and second mass components 702, 704, inserting cylindrical projections 708 into hole/slot receptacles 710. Thereafter, the user locks first and second mass components 702, 704 by applying oppositely directed rotational motion to both mass components 702, 704, moving cylindrical projection 708 from the holes to the slots of hole/slot receptacles 710. In a preferred embodiment, the user rotates first and second mass components 702, 704 in a clockwise direction when viewed from an anterior perspective at each end. One skilled in the art will recognize that raised protrusions 706 may be configured such that the two halves of a word or phrase will be aligned when first and second mass components 702, 704 are in the locked position. Upon completion of the rotating step, first and second mass components 702, 704 are held together in a unitary configuration. Thus, the present invention provides a multi-configuration toy that retains its unitary shape even during vigorous recreational activities.

In an alternative embodiment of multi-configuration ball 100, first mass component 120 may be coupled to center mass component 130 or second mass component 140 through a thread and screw assembly. The thread and screw assembly may be integrated into each mass component. For example, first mass component 120 may include a threaded screw protrusion at second side 506, while first side 512 of center mass component 130 would include a threaded screw receptacle. Further, second side 514 of center mass component 130 would also include a threaded screw protrusion and first side 522 of second mass component 140 would also include a threaded screw receptacle. Thus, multi-configuration ball 100 may be coupled together by inserting the threaded screw protrusions into the threaded screw receptacles of the thread and screw assembly.

In yet another embodiment of multi-configuration ball 100, the lock fastening unit may also be a thread and screw assembly, such that a first lock fastner is a threaded screw receptacle and a second lock fastner is a threaded screw protrusion. Also, center mass component 130 may include a threaded screw protrusion on a first side and a threaded screw receptacle on a second side. The multiconfiguration ball 100 may be coupled together by inserting the threaded screw protrusions of the lock fastner unit into the threaded screw receptacles of the lock fastner unit after both are passed through bores 502, 520 of mass components 120,140.

Figure 8C:
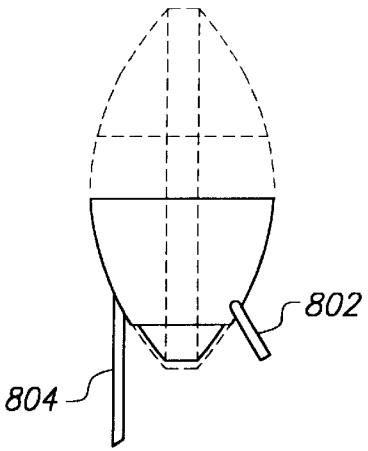
FIGS. 8A through 8D are an oblique view, side views, and an end view of a kickstand or tee accessory for a multi-configuration ball in accordance with the present invention.
Figure 8D:
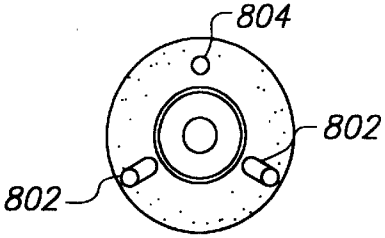
Figure 8A:
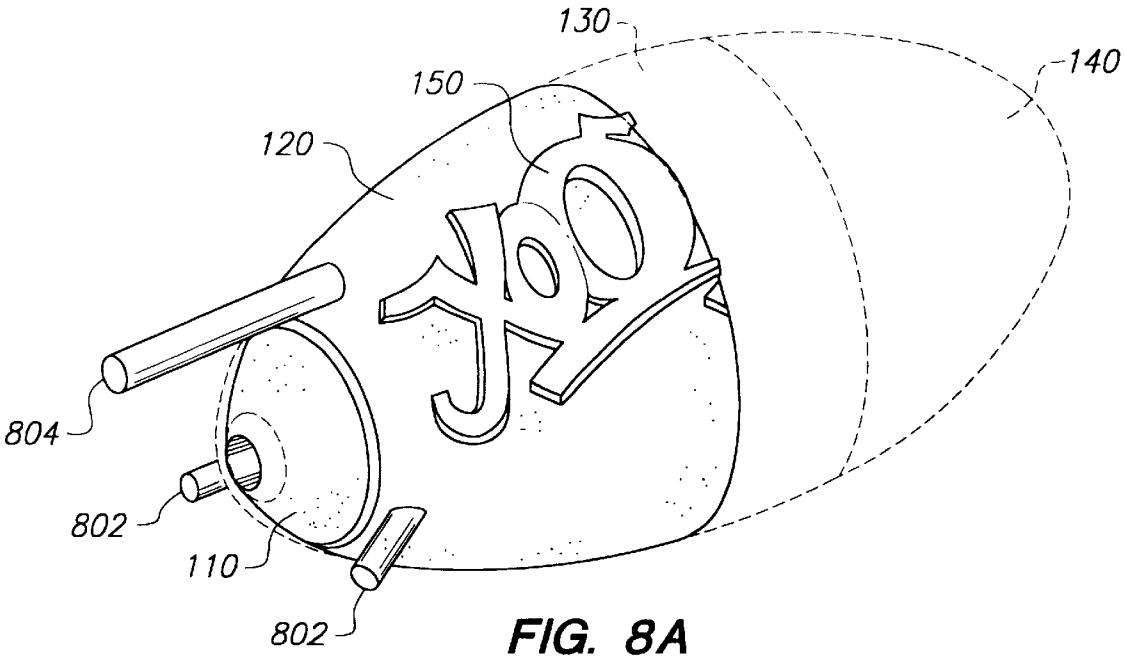
Figure 8B:
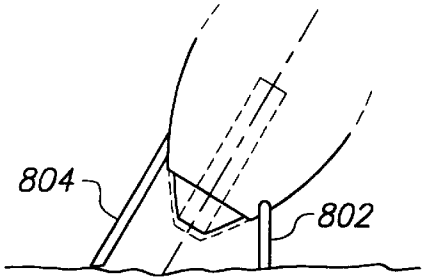

Referring now to FIG. 8A, there is shown an oblique view of an accessory for a multi-configuration ball 100. In accordance with the present invention, first mass component 120 comprises two short tubular protrusions 802 and one longer tubular protrusion 804 disposed at equidistant positions around first lock fastener 110. Together, tubular protrusions 802 and 804 form a kickstand or tee, whereby ball 100 may be placed on the ground at an angle as shown in FIG. 8B and kicked by a player. In a preferred embodiment, tubular protrusions 802 and 804 comprise a denser commercial polyurethane foam, giving the kickstand greater rigidity and structural stability. Although tubular protrusions 802 and 804 are illustrated as projecting from first mass component 120, tubular protrusions 802, 804 could also project from center or second mass components 130,140.

FIG. 8B illustrates the multi-configuration ball 100 resting on the kickstand tubular protrusions 802, 804. FIG. 8C illustrates a side view of multi-configuration ball 100 showing the positions of tubular protrusions 802, 804. FIG. 8D illustrates an end view of the first mass component 120 of the multi-configuration ball 100 having tubular protrusions 802, 804.

Figures 9A, 9B, 9C:
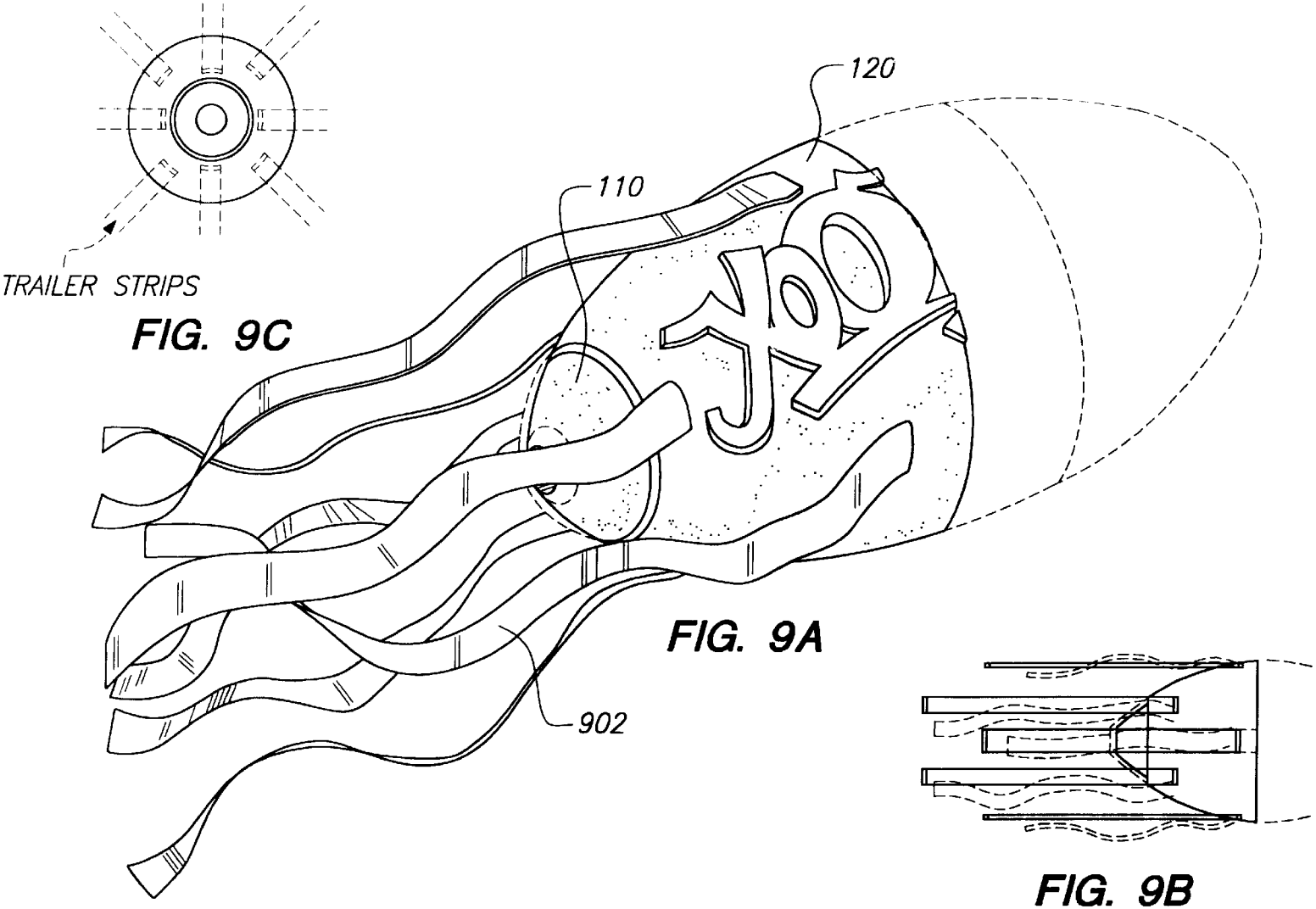
FIGS. 9A through 9C are an oblique view, a side view, and an end view of a streamer or trailer accessory for a multi-configuration ball in accordance with the present invention.

Referring now to FIG. 9A, there is shown an oblique view of an accessory for a multi-configuration ball 100. In accordance with the present invention, first mass component 120 comprises a plurality of streamers or trailers 902, having various lengths, sizes, and colors. Preferably, trailers 902 comprise light plastic or vinyl strips, and may be attached at various locations on the surface of first mass component 120 around first lock fastener 110. Although trailers 902 are illustrated as emanating from first mass component 120, trailers 902 may also emanate from center or second mass components 130, 140. FIG. 9B illustrates a side view of first mass protrusion 120 of multi-configuration ball 100 having streamers 902. FIG. 9C illustrates an end view of first mass protrusion 120 having streamers 902.

Figure 10C:
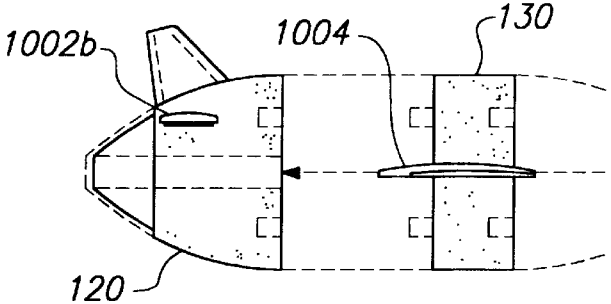
FIGS. 10A through 10E are oblique views, a side view, and end views of an aircraft accessory for a multi-configuration ball in accordance with the present invention.
Figure 10B:
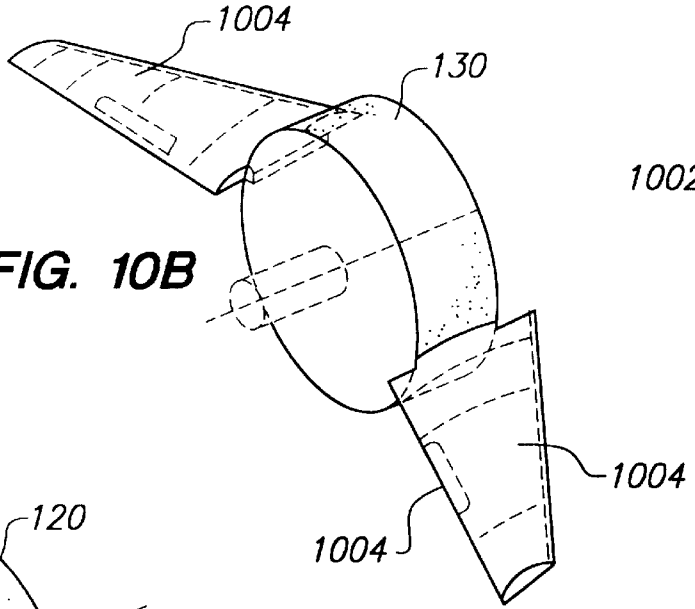
Figure 10E:
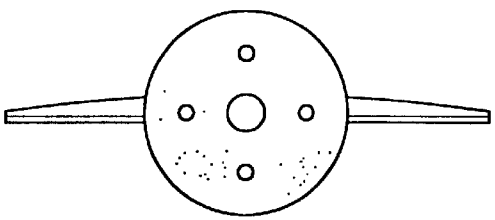
Figure 10D:
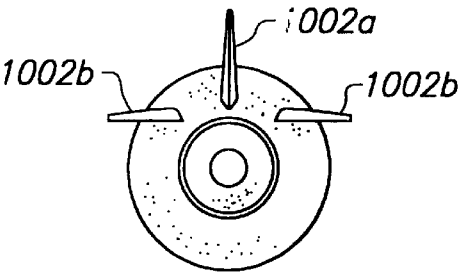
Figure 10A:
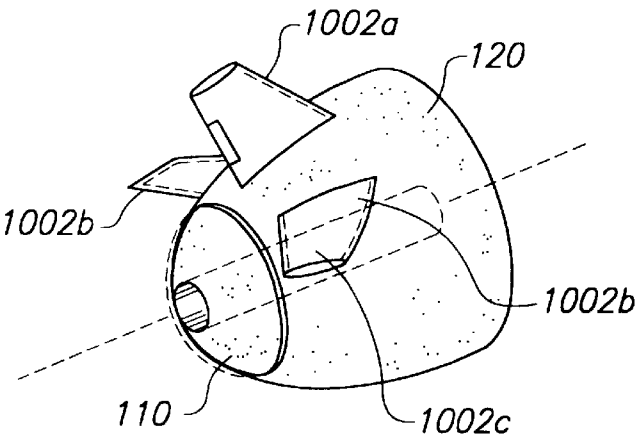
Figure 11B:
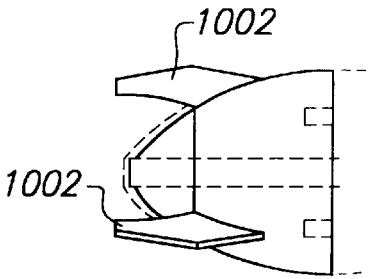
FIGS. 11A through 11C are an oblique view, a side view, and an end view of a bombshell accessory for a multi-configuration ball in accordance with the present invention.
Figure 11C:
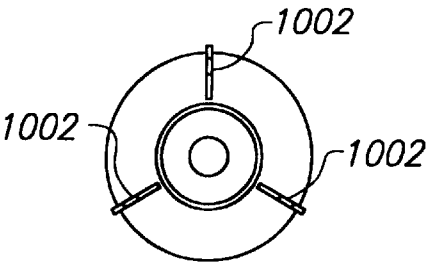
Figure 11A:
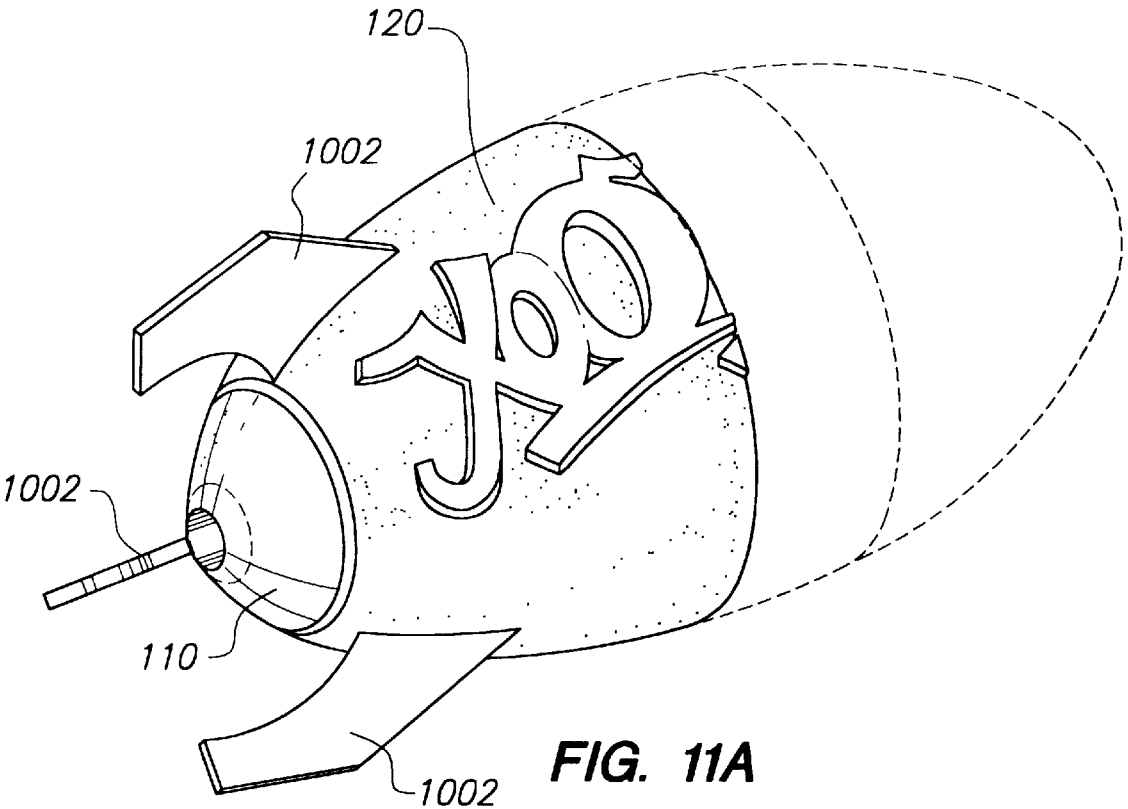

Referring now to FIGS. 10A and 10B, there is shown an oblique view of an accessory for a multi-configuration ball 100. In accordance with the present invention, first mass component 120 comprises three fin protrusions 1002 arranged in a configuration resembling the tail of an aircraft with, for example, one protrusion 1002*a* disposed vertically and two protrusions 1002*b*, 1002*c* disposed horizontally. Preferably, fin protrusions 1002 comprise a denser commercial polyurethane foam, giving the fins greater rigidity in thin segments for increased aerodynamic performance. Further, FIG. 10C is a side view of the multi-configuration ball 100 with horizontal and vertical protrusions 1002*a*, attached to first mass component 120, 1002*b* and wing protrusions 1004 attached to the center mass component 130. FIG. 10D illustrates fin protrusions 1002 from an end view of first mass component 120. FIG. 10E illustrates wing protrusions 1004 from an end view of the multi-configuration ball 100. Alternatively, fin protrusions may be notched as illustrated in FIGS. 11A through 11C, and arranged at equidistant positions around first lock fastener 110 to give ball 100 the appearance of a bombshell. FIG. 11A illustrates an oblique view of the multi-configuration ball 100 having fin protrusions 1002 notched on first mass component 120. FIG. 11B shows a side view of fin protrusions 1002 on the multi-configuration ball 100. FIG. 11C shows fin protrusions 1002 from an end view of first mass component 120 of multi-configuration ball 100. Additionally, wing protrusions 1004 may be added on opposite sides of center mass component 130 to further create the appearance of an aircraft as illustrated in FIGS. 10B, 10C, and 10E. Although protrusions 1002 and 1004 are illustrated as projecting from first and center mass component 120, 130, respectively, other combinations of wings and fins may be assembled on the three mass components.

Figure 12B:
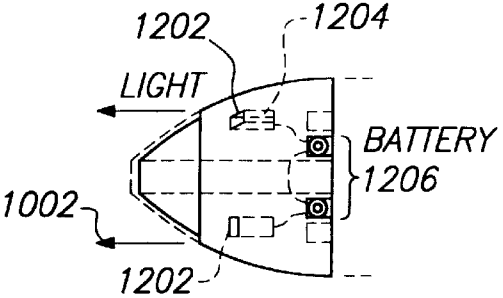
FIGS. 12A through 12D are an oblique view, a side view, and an end view of a light beacon accessory for a multi-configuration ball in accordance with the present invention.
Figure 12D:
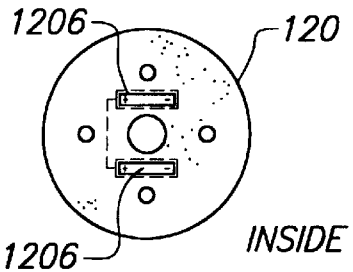
Figure 12C:
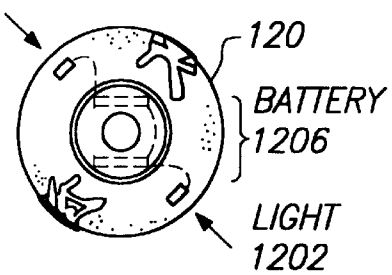
Figure 12A:
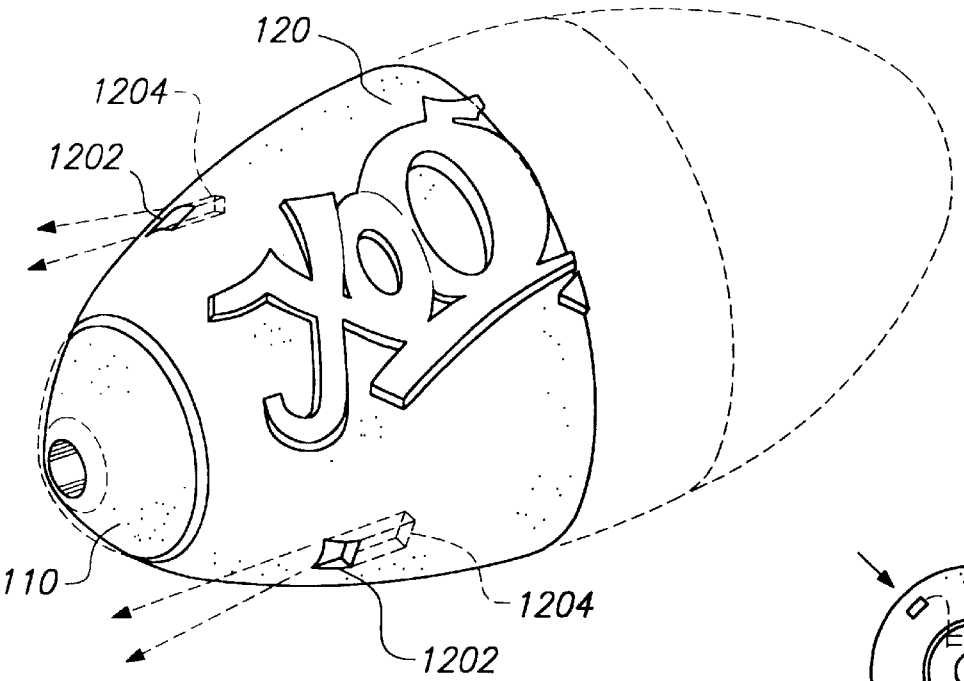

Referring now to FIG. 12A, there is shown an oblique view of an accessory for a multi-configuration ball 100. In accordance with the present invention, first mass component 120 comprises light beacons 1202 disposed within recessed areas 1204 of first mass component 120 on opposite sides of first lock fastener 110. Light beacons 1202 preferably comprise small, commercially-available light-emitting diodes or incandescent light bulbs. Beacons 1202 are coupled by conventional electrical circuitry to a lightweight energy source such as AAA batteries or the like located within the core of first mass component 120. Although light beacons 1202 are illustrated as being located in first mass component 120, beacons 1202 may also be located at various locations in center and second mass components 130, 140. FIG. 12B is a transparent side view illustrating light beacons 1202 and their connections to batteries 1206 in first mass component 120. FIG. 12C is an external end view of first mass component 120 showing location of light beacons 1202. FIG. 12D is a cross-section view of first mass component 120 showing locations for batteries 1206 for use with light beacons 1202.

From the above description, it will be apparent that the invention disclosed herein provides a novel multi-configuration amusement device with advantages over conventional balls and creativity-enhancing toys.

What is claimed is:

1. A multi-configuration amusement ball comprising:

a first partial conical component having a truncated end, a base end, and an open shaft extending from the truncated end to the base end of the first partial conical component and dimensioned substantially through a center of the first partial conical component; and a second partial conical component having a truncated end, a base end, and an open shaft extending from the truncated end to the base end of the second partial conical component and dimensioned substantially through a center of the second partial conical component;

a first portion of a locking mechanism having a first shaft configured to pass through the open shaft of the first partial conical component and to protrude from the base end of the first partial conical component, a first end of the first shaft to rest at the truncated end of the first partial conical component; and a second portion of a locking mechanism having a second shaft configured to pass through the open shaft of the second partial conical component to receive the first portion of the locking mechanism, a first end of the second shaft to rest at the truncated end of the first partial conical component, wherein a second end of the first portion of the locking mechanism and a second end of the second portion of the locking mechanism releasably couple the first and the second partial conical components, and wherein the first and second partial conical components are dimensioned to form a substantially ellipsoidal shape when releasably coupled.

2. The multi-configuration amusement ball in claim 1, wherein the second end of the second shaft is configured to receive the second end of the first shaft.

3. The multi-configuration amusement ball in claim 1, further comprising a substantially cylindrical component having an open shaft dimensioned substantially through a center of the substantially cylindrical component, the substantially cylindrical component disposed for insertion between the base end of the first partial conical component and the base end of the second partial conical component.

4. The multi-configuration amusement ball in claim 3, wherein the open shaft of the substantially cylindrical component is dimensioned to receive the first portion of the locking mechanism.

5. The multi-configuration amusement ball in claim 3, further comprising a third portion of the locking mechanism configured to pass through the open shaft of the substantially cylindrical component, the third portion of the locking mechanism having a first end dimensioned to receive the second end of the shaft of the first portion and a second end dimensioned to receive the second end of the shaft of the second portion of the locking mechanism.

6. An amusement ball comprising:

a first partial conical component having a truncated end, a base end, and an open shaft extending from the truncated end to the base end of the first partial conical component and dimensioned substantially through a center of the first partial conical component;

a second partial conical component having a truncated end, a base end, and an open shaft extending from the truncated end to the base end of the second partial conical component and dimensioned substantially through a center of the second partial conical component;

a substantially cylindrical component having an open shaft and configured for insertion between the base end of the first partial conical component and the base end of the second partial conical component;

a first portion of a locking mechanism having a first shaft configured to extend through the open shaft of the first partial conical component, a first end of the first shaft to rest at the truncated end of the first partial conical component; and a second portion of a locking mechanism having a second shaft configured to extend through the open shaft of the second partial conical component, a first end of the second shaft to rest at the truncated end of the first partial conical component, wherein a second end of the first portion of the locking mechanism and a second end of the second portion of the locking mechanism releasably couple the first and the second partial conical components and the substantially cylindrical component, and wherein the first and second partial conical components and the substantially cylindrical component are dimensioned to form a substantially football shape when releasably coupled.

7. The amusement ball in claim 6, wherein the open shaft of the substantially cylindrical component is dimensioned to receive a part of the first portion of the locking mechanism.

8. The amusement ball in claim 6, wherein the open shaft of the substantially cylindrical component is dimensioned to receive a part of the second portion of the locking mechanism.

9. The amusement ball in claim 6, wherein the locking mechanism further comprises a third portion configured to extend through the open shaft of the substantially cylindrical component, the third portion of the locking mechanism having a first end dimensioned to receive the second end of the shaft of the first portion and a second end dimensioned to receive the second end of the second portion.

* * * * *